United States Patent [19]

Zöllner et al.

[11] 4,009,675

[45] Mar. 1, 1977

[54] FLOAT DEVICE WITH AT LEAST ONE FLOAT BODY

[76] Inventors: Nikolaus Waki Zöllner, Kaiserplatz 8, D-8 Munich 40; Hanfried F. Schwark, Maria-Theresia-Strasse 6, D-8 Munich 80, both of Germany

[22] Filed: Nov. 14, 1974

[21] Appl. No.: 523,663

[30] Foreign Application Priority Data

Nov. 16, 1973 Germany ..... 2357398

[52] U.S. Cl. ..... 114/267; 9/8 R

[51] Int. Cl.[2] ..... B63B 5/24

[58] Field of Search ..... 9/8 R, 8 P, 340; 114/68, 69, 0.5 T, 0.5 F

[56] References Cited

UNITED STATES PATENTS

| | | | |
|---|---|---|---|
| 1,088,239 | 2/1919 | Paine | 114/.5 F |
| 3,049,732 | 8/1962 | Martin | 114/230 X |
| 3,182,340 | 5/1965 | Gentile | 9/8 R |
| 3,390,656 | 7/1968 | Flowers | 114/39 |
| 3,581,692 | 6/1971 | Mortellito | 1 A/.5 F |
| 3,622,437 | 11/1971 | Hobaica | 114/69 |
| 3,733,631 | 5/1973 | Cohn | 9/340 |
| 3,803,651 | 4/1974 | Moore | 9/8 R |

*Primary Examiner*—Trygve M. Blix
*Assistant Examiner*—Gregory W. O'Connor
*Attorney, Agent, or Firm*—Anthony J. Casella

[57] ABSTRACT

The specification describes a float device with at least one float body which forms a support surface element and has at least one skin which is resistant to water and forms a chamber. The chamber is filled up at least partly with plastic foam having closed pores and extending along the whole inner periphery of the flexible skin.

2 Claims, 6 Drawing Figures

FLOAT DEVICE WITH AT LEAST ONE FLOAT BODY

BACKGROUND OF INVENTION

1. Field to which invention relates

The invention relates to a float device with at least one float body, which forms a support surface element and has at least one skin which forms a chamber and is resistant to fresh and/or salt water.

2. The prior art

In the case of previously proposed float devices, which serve for forming a support surface floating on the water, the float bodies are hollow bodies with a rigid or flexible skin of metal, wood or plastic. The hollow float bodies are liable to damage. In the case of damage the gas providing for buoyancy, for example air in the interior space can be displaced so that the hollow body and the superstructure may well sink.

Furthermore, hollow bodies with a rigid skin involve high transport costs for movement from the factory in which they are produced to the site of use, while hollow bodies with a flexible skin are easily damaged when used.

SUMMARY OF INVENTION

One aim of the invention is the provision of a float device of the initially specified type in the case of which while providing for a simplified construction in conjunction with ready transportability from the factory to the site of use without the danger of damage which might cause sinking, it is possible to provide for optimum buoyancy and a long period of life.

In order to attain this aim and other aims there is the provision in accordance with the invention that the chamber is at least partly occupied by plastic foam having closed pores and which extends along the whole interior periphery of the flexible skin.

A substantial advantage of the invention resides in that even in the case of damage or even piercing of the flexible skin there is no danger of the device itself sinking, since the closed porous plastic foam takes up practically no water, that is to say at the most 1% water per year when it is left floating without protection in sea water with a salt content of 35 per mille. Any damage which may occur to the skin can readily be repaired by sticking material over the damaged parts.

A further substantial advantage of the invention resides in that a very high buoyancy force can be achieved. The buoyancy force or upthrust amounts for example in the case of a float device with a maximum diameter of 30 meters, and which is made up of four float body rings and a total weight of approximately 30,000 kg with a total volume of 556 cubic meters in the case of an available or working surface of 552 square meters, approximately 900 kg per square meter.

A further advantage of the invention resides in that the float device on transport from the site of production or the factory to the site of use requires little space and has a small weight, since the components for the device, that is to say the prefabricated flexible skin and the foam material can be transported separately in bales and in drums to the site of use and can be used there in a simple manner for producing the device.

In the case of smaller volumes of the chamber the latter is advantageously completely filled with the closed pore plastic foam, while in the case of devices with larger volumes of the chamber it is preferred for the plastic foam material with closed pores to include within it a sealed inner space.

In the case of an advantageous embodiment of the invention the closed pore plastic foam material is divided up into at least two zones and in the outer zone adjacent to the skin and along their whole inner periphery it is formed more densely and with a higher bulk weight than in the inner zone of the chamber. The volume weight of the closed pore plastic foam is in this case in the outer zone along the whole inner periphery of the skin advantageously between 50 and 100 kg per cubic meter and preferably between 60 and 80 kg per cubic meter, while the closed pore plastic foam in the outer zone advantageously has a thickness between 3 and 10 cm and preferably between 5 and 6 cm.

The volume weight of the closed pore plastic foam in the inner zone advantageously amounts to three to four fifths, and preferably one to two fifths of the volume weight of the closed pore plastic foam in the outer zone.

Advantageously the closed pore plastic foam is a water-resistant foam, which can be foamed below the deformation temperature of the skin, more particularly a polyurethane foam.

For economic production it is possible for the closed pore plastic foam to be extended in the inner zone of the chamber with foreign materials having similar mechanical properties, in the case of which preferably as foreign materials use is made of styropor spherulets.

Advantageously the inner space is separated from the closed pore plastic foam by an inner skin, and is preferably additionally divided up by partitions.

This achieves the advantage that in the case of any possible damage piercing the whole plastic foam layer it is only in a separate part of the inner space into which water can pass and for the device itself there is no danger of sinking.

It is, however, also possible to introduce in an advantageous manner gases, liquids and/or solids through a channel or duct accessible through the outer skin and leading to the interior space, into the latter space, or, respectively, to remove them from it. These materials can serve to balance the float device, to ballast it or to increase the buoyancy to a still greater degree. It is also, however, possible to build up a store of food and fuel and serve for a prolonged occupancy of the float device by persons.

Advantageously the outer skin is a tough, elastic plastic foil, for example a foil as used for swimming pools, which advantageously has a thickness between 1 and 2 mm, and preferably has a thickness of 1.5 mm.

In accordance with a further advantageous embodiment of the invention the outer skin consists of plastic-coated fabric.

The outer skin is in the case of a preferred embodiment of the invention made up of individual strips or webs, for example by welding or sewing.

In accordance with a particularly preferred embodiment the float body with its outer skin and the plastic foam material with closed pores arranged in the outer skin, is constructed as a closed or full annular body, which advantageously forms an ellipse or a circle.

In accordance with a preferred embodiment of the invention the annular body has a circular cross-section, though preferably it has an elliptical cross-section, in the case of which, advantageously, it has a flattened plane surface, which runs generally parallel to the major axis of the elliptical cross-section, and preferably, when the annular body is floating, is on the top side.

Furthermore, advantageously, the annular body comprises a hollow inner annular space, possibly with separating walls or partitions, which divide up the annular space into sections separated from each other. The center of gravity of the inner annular space is advantageously — looked at in the cross-section of the annular body — adjacent to or at the center of gravity of the annular body itself, and in the case of the two centers of gravity not coinciding they preferably lie on a line which runs generally parallel to the normals of the annular surface.

Preferably at least two annular bodies are provided, which are placed one inside the other concentrically. In this respect these concentrically placed annular bodies lying one inside the other are connected with each other by coupling members preferably, which hold them in relation to each other so that the bodies are held together as regards rotation in the peripheral direction, though as regards their support surface they can move upwards and downwards independently.

Preferably the concentrically arranged annular bodies lying one inside the other have at least some spacing between them, in the case of which the annular bodies arranged with a spacing between them are connected together at discrete positions which have generally the same spacing between them or continuously along their whole annular periphery.

In the case of a preferred embodiment of the invention the annular bodies arranged with a spacing between them are connected with each other by cords, chains or ropes, while in the case of another advantageous form of embodiment the annular bodies arranged with a spacing between them are connected together by a foil, which forms an annular surface between the bodies.

A substantial advantage as regards the use of an annular body or a number of annular bodies for the float device resides in that the annular bodies cannot turn turtle, present considerable opposition to sudden movements of the water and in the case of squalls remain still in the water.

A further advantage of this annular construction resides in that owing to the suction effect between the bodies and the water the float device has a relatively high resistance to rocking movements in choppy or rough water.

In fact in the case of a float device with several annular bodies the outer one of these overcomes the force of the waves and diverts this force without the device itself being caused to move substantially. This breaking and diverting of the force of the waves has a surprisingly favourable effect which occurs in the case of a circular construction of the float device.

A further advantage of the annular construction is that in the interior space of the annulus there is an extent of still water.

If required it is possible to provide a stabilising device which at discrete positions of attachment is connected with at least one annular body via ropes, which run together towards a common nodular point lying on the principal axis of the device lying under water, with which a stabilizing ballast weight is connected. In this respect it is advantageous to connect a sheet anchor with the ballast weight.

A substantial advantage of this construction of the stabilising device resides in that it is only effective in the case of unbalanced loading of the float device owing to temporary, unfavourable distribution of the load or owing to wave or wind forces, since the ballast weight acts via the ropes on the zone which is diametrically opposite to the zone of the loading, and thus it tends to hold the floating device in its original horizontal position. In the case of a sheet anchor which is open in an upward direction any rolling or rocking movements of the overall device still occurring with the ballast weight are damped and substantially suppressed.

Advantageously at least one anchor is provided, which on one side of the device is connected with the latter, about which the device can swing when the anchor has been let out. If swinging or drifting at anchor is to be avoided, a second anchor can be put out connected with another part of the device.

Advantageously the float device is constructed as an annular floating raft, and is used in a lake or at sea as an anchored raft, for example as a bathing raft with an enclosed still water pool, as a mooring site in a lake or near the sea shore which is anchored, for motor boats, sealing boats and/or yachts, as a recreation center for bathing beaches or as a raft for floating hotels.

In the case of the preferred embodiment of the invention as a raft and inflated room is provided, while advantageously at least the annular bodies have different cross-sectional heights, which increase preferably from the center of the device in an outward direction.

An advantageous application as a raft for floating hotels is for example to be used for sea air therapy for the treatment of hay fever, bronchitis etc. Furthermore, in the case of hotels located on shore air can be passed by specially provided ducts and blowers serving to pump sea air into the respective treatment room. In the case of the device in accordance with the invention as a raft for such a hotel the patients are always directly connected with sea air, while an air inflated room serves to protect them from the weather. In this respect it is possible, in a particularly simple manner, to hold the inflated room upright, since the annular bodies lying on the water provide a satisfactory sealing action for the floor of the inflated room.

The device in accordance with the invention can, in the case of an annular construction, also be used in an advantageous manner as a hotel island for trips on the sea, anglers, fishing on the high seas, yacht owners, as an operational base for marine research or for commercial fishing, as a base for marine aquariums, for a shark or dolphin show, as a fish farm (an enclosed water in a lake or in the sea), a dwelling island for persons employed in marine construction sites, boring islands and islands for fish farms or as a base island for marking navigational roots for marine traffic.

In the case of a preferred method for the production of a float device there is the provision in accordance with the invention that for the production of a float body individual foil and/or plastic coated fabric strips are connected together by welding and/or sewing to form a flexible tube, which forms the skin, in that the tube for forming the desired shape of the float body is supported with a chamber with predetermined internal dimensions in its interior, and more particularly is inflated, and the so formed chamber is filled by foaming to produce closed pore plastic foam. In this respect advantageously in the outer zone between the chamber along the whole inner periphery of the skin an annular layer of closed pore plastic material foam with a high density and strength is applied and following this the inner zone within the outer layer stabilising skin is filled by foaming with closed pore plastic foam with a low density, which is possibly extended with foreign materials having similar mechanical properties.

In the case of an advantageous embodiment before the final foaming out or filling out with foam of the float body in the interior of the outwardly curved skin for forming the chamber a foil tube, inflated with gas or air, is arranged, which forms an inner skin surrounding an interior space.

Advantageously use is made of a shaping plate with a predetermined cross-sectional form, which is introduced to the finished skin, while rotating foam spray guns apply the annular layer of closed pore plastic foam with a high density and strength in the outer zone of the chamber along the whole inner periphery of the skin.

In accordnce with an advantageous method for producing an annular body there is the provision that from the foil or, respectively, fabric strips two surface pieces are put together by welding and/or sewing, which are larger than the overall surface of the annular body, in that the two surface pieces are laid one on top of the other and in that the surface pieces laid one on top of the other are welded or sewn together respectively along the predetermined interior periphery and outer periphery of the annular skin to be produced for the formation of an annular tube.

In this respect for the production of a device with several coaxially arranged annular bodies one inside the other it is advantageous to adopt the feature that the parts, projecting between the annular skins produced, of the surface pieces are left as double foil or double fabric, respectively, which forms an annular surface between the annular bodies.

In accordance with a further advantageous embodiment it is possible to adopt the feature that the annular bodies initially connected with each other by the projecting parts of the surface pieces are separated from each other and are tight together by means of cords, chains or ropes, which for example are passed through eyes arranged on the periphery of the annular bodies.

In the case of a further advantageous method for the production of a device with several annular bodies arranged coaxially one inside the other there is the feature that the individually made annular bodies are laid one inside the other and are so tight together with ropes that they are held together coaxially.

Preferably the skin is prefabricated in a factory and filled out with foam or foamed out at the site of use.

List of several views of drawings

The invention will now be explained with reference to the accompanying drawings by way of example.

DESCRIPTION OF PREFERRED EMBODIMENTS

Figure 1:
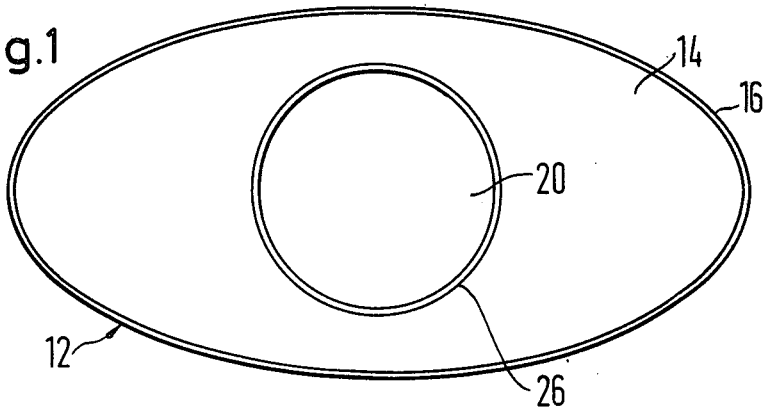
FIG. 1 is a diagrammatic cross-sectional view of a float body with an elliptical cross-sectional profile.
Figure 2:
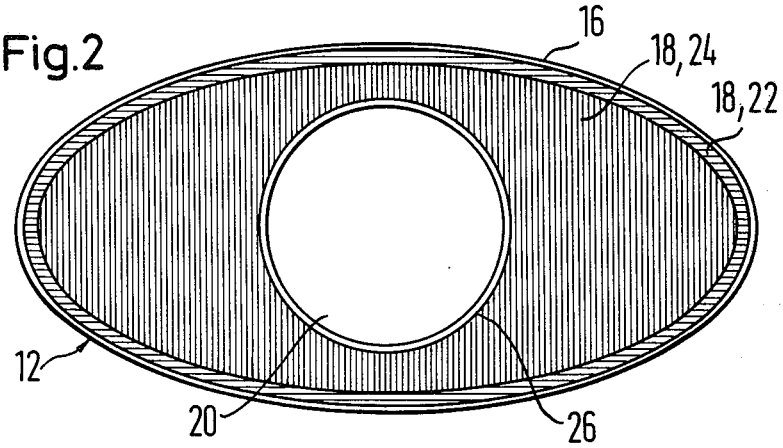
FIG. 2 is a diagrammatic cross-sectional view similar to FIG. 1, in which the two zones are indicated which have closed pore plastic foam differing in density.
Figure 3:
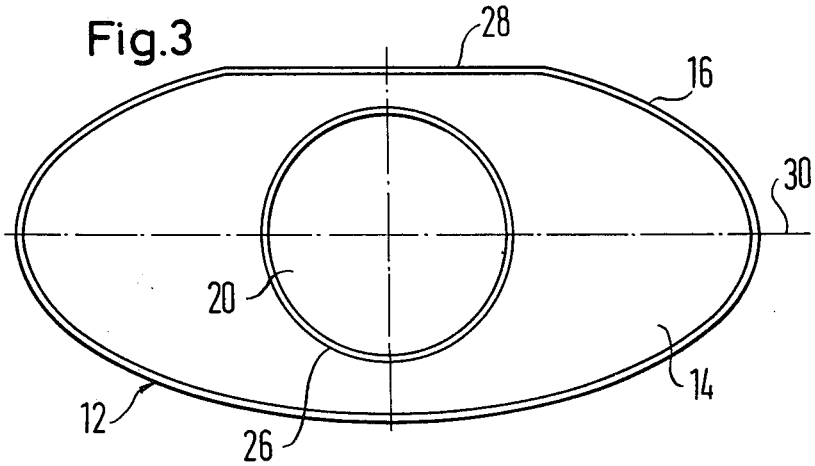
FIG. 3 is a diagrammatic cross-sectional view, in which the float body is represented with a flattened plane surface, which runs parallel to the major axis of the elliptical cross-section.

In accordance with FIGS. 1 to 3 a float body 12 comprises a chamber 14 which is surrounded by a skin 16. The chamber 14 formed by the skin 16 is filled or foamed out with closed pore plastic foam 18, which extends along the whole inner periphery of the skin 16. In the center of the closed pore plastic foam a hollow interior space 20 is left, which is separated from the closed pore plastic foam by an inner skin 26.

In accordance with FIG. 2 the closed pore plastic foam 18 is divided up into two zones 22 and 24. The plastic foam 18 is produced with a high bulk weight and consequently with a high density in the outer zone 22, adjacent to the skin 16, along its whole inner periphery. In this outer zone 22 the closed pore plastic foam has a volume weight of 60 to 80 kg per cubic meter. The layer of denser closed pore plastic foam in the outer zone 22 measures 5 cm. The annular inner zone 24 between the outer zone 22 filled out with dense plastic foam, and the inner space 20 left empty is filled with a plastic foam with closed pores and a lower density, its volume weight amounting to two fifths of the volume weight of the dense plastic foam in the outer zone 22. The less dense plastic foam in the inner zone 24 can, in order to reduce the costs of foam material, be extended with foreign materials having similar mechanical properties as for example styropor spherulets.

In accordance with FIG. 3 the float body 12 along its outer profile has the shape in cross-section of an ellipse apart from a flattened plane surface 28, which runs parallel to the major axis 30 of the ellipse. This flattened surface 28 serves as a support surface and facilitates the erection of building structures on the float body.

Figure 4:
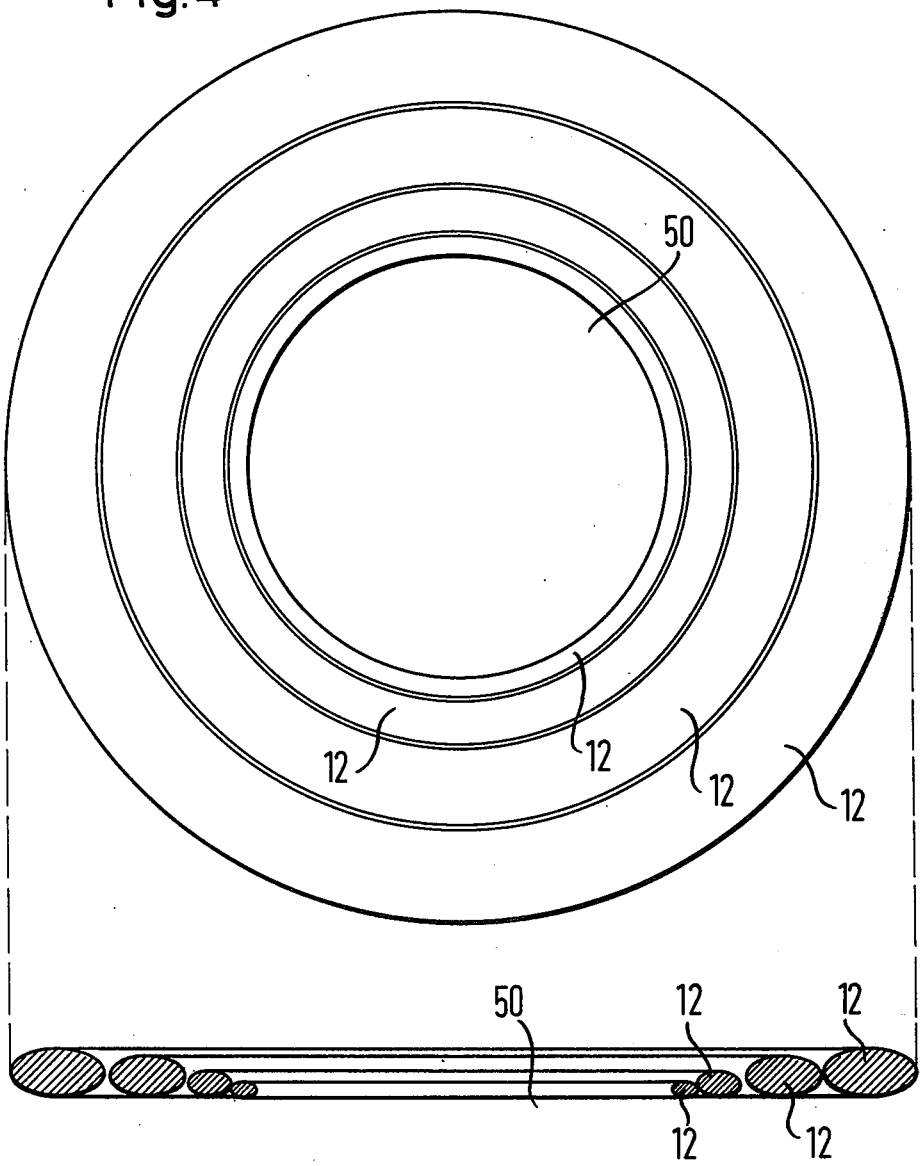
FIG. 4 is a diagrammatic plan view and cross-section of a float device, which comprises four annular bodies placed coaxially one inside the other, which are immediately adjacent to each other.
Figure 5:
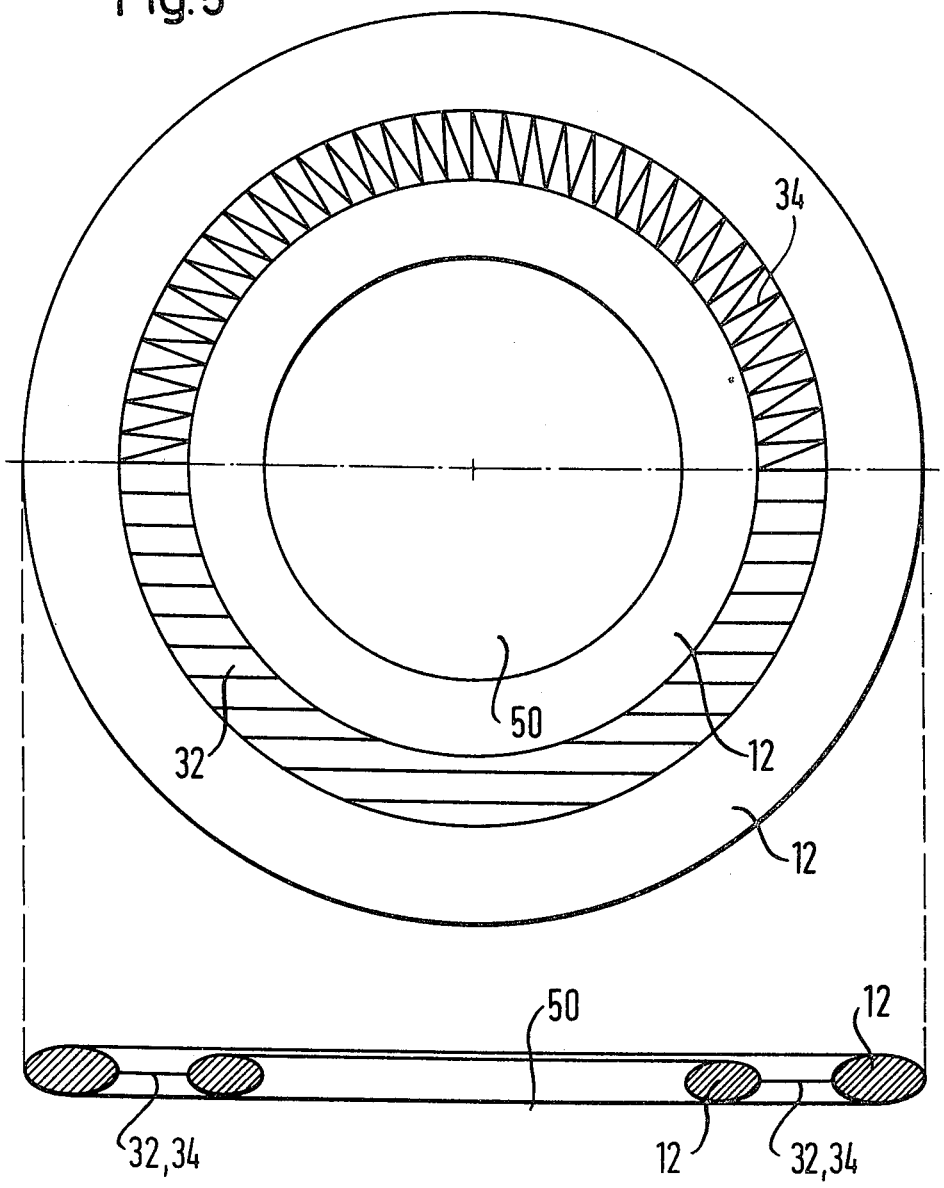
FIG. 5 is a diagrammatic plan view and cross-section of a float device with two annular float bodies, arranged one inside the other, which are connected with a spacing between them so as to be coaxially spaced, on the one half of the figure by means of a continuous annular foil and in accordance with the other half of the figure by means of a rope.

In FIGS. 4 and 5 two embodiments are represented in the case of which the float device comprises four or, respectively, two float bodies constructed as complete or closed rings. In the case of this embodiment it is possible in a simple manner to produce a large support surface using a few individual elements, and the whole structure has a high buoyancy. It is for example possible to achieve a low carrying capacity or buoyancy of 900 kg per square meter with a float device with an external diameter of 30 meters, which is made up of four float body rings 12 and in the case of an overall volume of the annular bodies of 556 cubic meters has a total weight of approximately 30,000 kg.

In the case of the embodiment of the invention shown in FIG. 5 the two annular bodies 12, placed concentrically one inside the other, have a spacing between them and are connected via cords 34, as shown in the upper half of FIG. 5, or by means of a continuous annular foil 32, as shown in the lower half of FIG. 5, are connected with each other in such a manner that they are prevented from rotating in relation to each other in the peripheral direction, but as regards their load carrying surface they can rise and sink independently of each other.

The cross-sectional heights of the annular bodies placed concentrically one inside the other, can be the same. Different cross-sectional heights can, however, facilitate the arrangement of superstructures.

Figure 6:
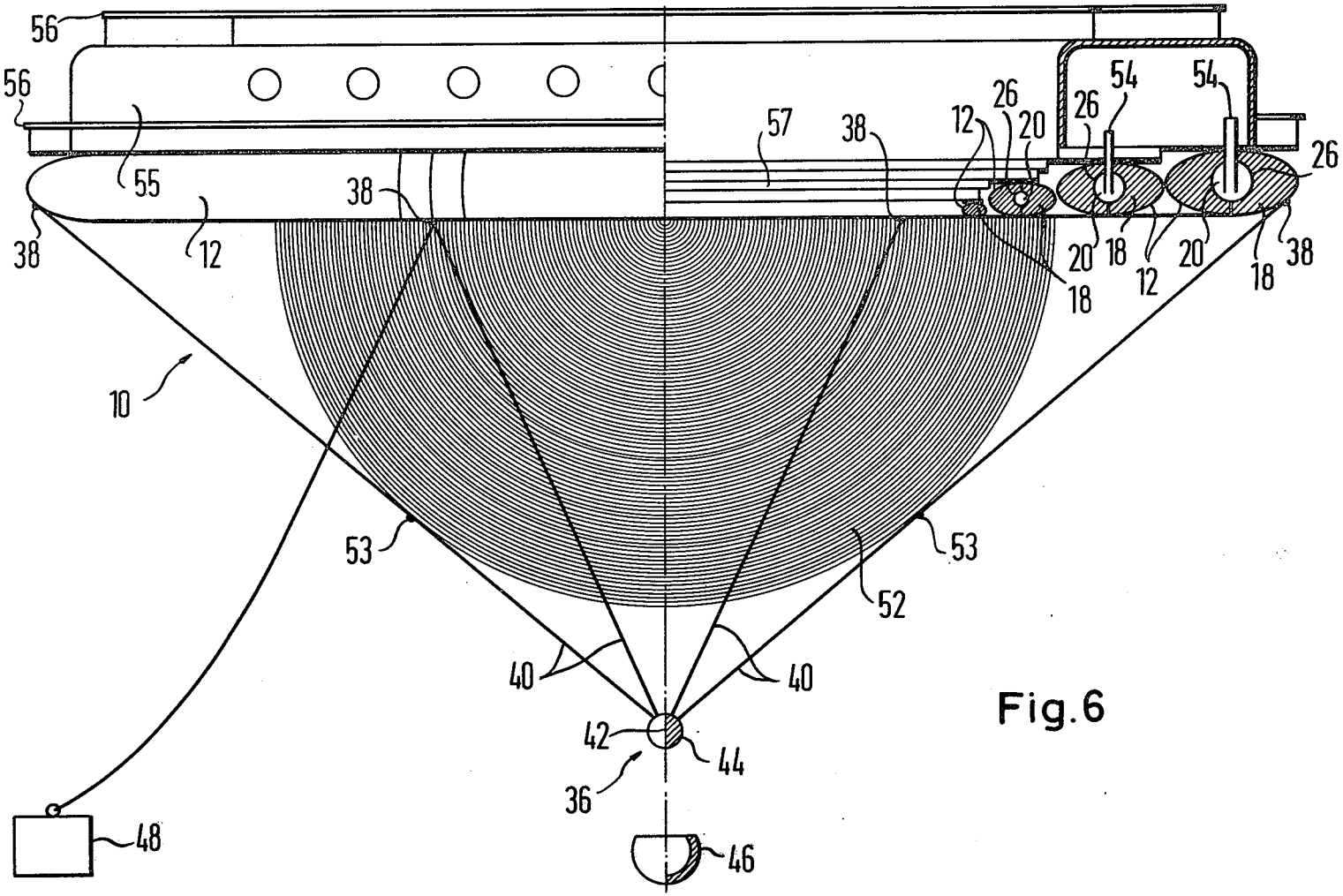
FIG. 6 is a diagrammatic side profile view of a float device which is constructed as an annular floating raft.

FIG. 6 shows an embodiment in the case of which the floating device 10 is constructed as a load carrying raft for superstructures 55 with a planked structure 57 and a railing 56. The device 10 has in this respect at the same time a stabilising device 36, which is connected by means of ropes 40 at separate points of attachment 38 with the device. The ropes 40 run under water to a tying point 42, which is formed by a ballast weight 44. An upwardly open sheet anchor 46 is connected with the ballast weight 44. Furthermore, the device 10 has an anchor 48, with which it can be anchored at any suitable point in a lake or at sea. Attached to the inner annular body 12 there is a safety net 52, which protects the water zone under the annular opening of the device 10 against the ingress of sharks or other fish. The safety net 52 can be connected at individual points 53 with the ropes 40 of the stabilising device so that it is held drawn down under all conditions in the water.

In the case of the device shown in FIG. 6 the cross-sectional height of the annular bodies 12 decreases from the outside towards the inside of the overall annular surface. Since the annular bodies 12 lie on the water surface at approximately the same height, the differing cross-sectional heights achieve a gradation or stepping of the surfaces of the annular bodies 12 from the inside of the device to its outside in an upward direction. In this manner it is possible in a simple way to come into the still water zone surrounded by the rings, while on the other hand the largest annular body 12 on the outer side of the device 10 acts as a wave breaker, against which the waves act in the peripheral direction of the annular body 12 and accordingly loose their force. The free inner spaces 20 provided in the larger annular bodies 12 can in the case of this device to be used as storage tanks for gases, liquids, and solids, for fuels and foods and for damping materials such as sewage.

The annular bodies shown in the drawing are produced by cutting from a tough, elastic plastic foil with a thickness of approximately 1.5 mm, for example a sewing pool foil, or from a plastic coated fabric, strips, laying the strips parallel to each other and connecting them together, that is to say welding them together or sewing them together. The foil surfaces so prepared are laid one on top of the other so that the previously produced seams intersect. In the center of the foil surface a hole is cut out, through which a pulse welding device with circular segment shaped welding electrodes can be introduced. With these electrodes having the form of circular segments two circular seams, that is to say one seam along the outer periphery and one seam along the inner periphery of the annular skin to be produced, are produced by welding. Two seams running parallel in this manner then represent a foil tube. The double foil projecting beyond this foil tube can be cut off or left projecting and used as an attachment for eyes or distance pieces. If the tubes for all annular bodies to be laid one inside the other are to be produced simultaneously, the foil surfaces lying between the tubes can be left and in this manner they form double foil annular surface spacing means.

The prefabricated foil annular tubes are then transported to the site of use, laid out flat and filled with air up to a certain degree, that is to say that they form curved rings, which in cross-section have an elliptical profile and are supported by a flat supporting surface. Through an opening cut out of the inflated annular tube the filling material, a closed pore plastic foam, is filled in. The inner side of the annular skin is regularly covered along its whole periphery with a foam layer with a thickness of about 5 cm so that the annular skin is fixed in its inflated condition. This outer plastic foam layer has a volume weight of approximately 60 to 80 kg per cubic meter. In the case of filling the remaining interior space up with foam, the foam expansion pressure which occurs is taken up by the outer foam layer and cannot act on the foil.

Instead of inflating the annular skin it is also possible to introduce a shaping plate through an opening. The plate is drawn slowly through the annular skin, while its outer periphery slids along the inner side of the skin and rotating foam material spray guns throw a regular foam layer against the inner side of the annular skin. After a short pot life and standing time for the foam the shape of the annular skin is fixed by the hardening or curing plastic foam in the shape of the plate.

If in large annular bodies a hollow interior of space is to be left, after the curing of the outer foam material layer a foil tube, inflated with air, is fixed in the interior of the ring body with spacers or distance pieces. The annular space remaining between the annular skin and the inflated foil tube is foamed out or filled up with foam having a low bulk weight. In all other cases the space remaining free inside the outer foam layer is fully filled up with foam after hardening. Following this the annular skins filled with foam can be closed in a watertight manner by welding or sticking.

Before placing the rings filled with foam on the water, they are turned around so that the flat space which was previously lying on the ground faces upwards and can serve as a support surface for superstructures.

The annular float bodies cannot turn turtle, offer considerable resistance to sudden water movements, and in squalls lie still relatively resistant to rolling in the water, since owing to a suction effect there is a strong adhesive effect between the water surface and the annular surfaces lying on it.

Furthermore, an annular ring or toroidal construction is particularly suitable for overcoming the forces of the waves without excessive movement of the annular body being brought about.

In the case of an advantageous embodiment between the annular bodies and the fixed abutment surfaces or resting surfaces shock absorbers are arranged which prevent or considerably reduce the transmission of wave forces of the water to the superstructures.

A pneumatic wave breaker is advantageously provided outside the island or raft, which breaks high waves. In the case of such pneumatic wave breakers air bubbles serve to produce turbulence so that owing to the rising water air mixture the orbital movement is interfered with.

The floating raft or supporting island in accordance with the invention is also suitable as a mussel bank for culturing pearls outside the litoral zone in healthy water.

In the case of a non-circular construction of the float body the device in accordance with the invention can also be used advantageously as a floating wave breaker in conjunction with a stabiliser and sheet anchor system or break water in front of the entrances to harbours and bathing bays, as a mooring structure for boots or as part of a floating bridge such as a pontoon bridge.

What we claim is:

1. A method for the production of a float device having at least two annular bodies coaxially held together by ropes, said bodies being produced simultaneously, said method comprising the steps of:

a. forming each annular body by, 1. placing a first foil surface piece on top of a second foil surface piece, said first and second surface pieces being larger than the overall surface of the annular body to be formed; and 2. connecting said first and second surface pieces along a predetermined interior periphery and outer periphery to produce an annular tube having a chamber of predetermined internal dimensions, the portions of the surface pieces disposed beyond the tube so formed defining projection portions which connect the tube to an adjacent tube being simultaneously formed;

b. inflating said chamber;

c. partially filling said chamber along the inner periphery of the tube with an annular layer of a closed pore plastic foam having a high density;

d. then filling the remaining area of the chamber with a closed pore plastic foam having a low density and extended with foreign material having similar mechanical properties;

e. separating the annular bodies initially connected with each other by the projecting portions of the surface pieces; and f. tying the annular bodies together by means of ropes so that relative peripheral movement between the annular bodies is prevented.

2. A method for the production of a float device having at least two annular bodies coaxially held together by ropes, said annular bodies being produced individually, said method comprising the steps of:

a. forming each annular body by:

1. placing a first foil surface piece on top of a second foil surface piece, said first and second surface pieces being larger than the overall surface of the annular body to be formed;

2. connecting said first and second surface pieces along a predetermined interior periphery and outer periphery to produce an annular tube having a chamber of predetermined internal dimensions, said tube having projecting foil surface portions;

inflating said chamber;

partially filling said chamber along the periphery of the tube with an annular layer of a closed pore plastic foam having a high density;

then filling the remaining area of the chamber with a closed pore plastic foam having a low density, and extended with foreign material having similar mechanical properties;

arranging each of said individually formed annular bodies coaxially one inside the other; and tightly tying said bodies together with ropes so that they are held together coaxially and whereby relative peripheral movement between the annular bodies is prevented.

* * * * *